US011015803B2

(12) United States Patent
Huang et al.

(10) Patent No.: US 11,015,803 B2
(45) Date of Patent: May 25, 2021

(54) COMBUSTION DEVICE

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 123 days.

(21) Appl. No.: 16/180,861

(22) Filed: Nov. 5, 2018

(65) Prior Publication Data

US 2020/0141571 A1 May 7, 2020

(51) Int. Cl.
*F23D 14/14* (2006.01)

(52) U.S. Cl.
CPC ..... *F23D 14/14* (2013.01)

(58) Field of Classification Search
CPC ..... F23D 14/14; F23D 14/125; F23D 14/145; G02B 5/09; G02B 5/10; F24C 15/24; A21B 2/00
See application file for complete search history.

(56) References Cited

U.S. PATENT DOCUMENTS 589,376 A * 8/1897 Trobach ..... F21H 1/02 252/492
951,060 A * 3/1910 Driessche ..... F23D 14/125 431/347
1,048,016 A * 12/1912 Wiederhold ..... F23D 14/125 431/347
1,054,333 A * 2/1913 Bourrelly ..... F23D 14/125 431/347
1,145,500 A * 7/1915 Monosmith ..... F23D 14/125 431/347

(Continued)

FOREIGN PATENT DOCUMENTS

CN 103236589 A 8/2013
CN 204380436 U 6/2015

(Continued)

OTHER PUBLICATIONS

English Abstract for TWM543657, Total of 1 page.

(Continued)

*Primary Examiner* — Jorge A Pereiro
(74) *Attorney, Agent, or Firm* — R. Lynette Wylie; Apex Juris, PLLC

(57) ABSTRACT

A combustion device includes at least one burner, a supporting assembly, and an infrared ray generation assembly. The at least one burner includes a flame outlet; the front cover of the supporting assembly includes a flat cover plate which has a plurality of holes; the infrared ray generation mesh which is disposed on the supporting assembly is corresponding to the flame outlet; the flames generated by the flame outlet heat the infrared ray generation mesh and the cover plate. The intensity of heating can be effectively increased by generating open fire and infrared rays and uniformly heating could be realized as well.

16 Claims, 11 Drawing Sheets

(56) References Cited

U.S. PATENT DOCUMENTS 1,277,392 A * 9/1918 Dalen ..... F23D 14/125 431/347
1,312,046 A * 8/1919 Perry ..... F23D 14/125 431/347
1,404,912 A * 1/1922 Tobias ..... F24C 15/24 126/92 R
1,420,688 A * 6/1922 De Laitte ..... F24C 3/047 126/39 J
1,501,631 A * 7/1924 Taylor ..... F23D 14/10 431/347
RE16,122 E * 7/1925 Risinger ..... F24C 15/24 126/92 R
1,668,612 A * 5/1928 Slattery ..... F24C 3/082 126/92 AC
1,677,156 A * 7/1928 Vaughn ..... F23C 99/00 431/328
1,699,624 A * 1/1929 O'Dowd ..... F24C 3/085 126/39 J
1,743,051 A * 1/1930 Stuart ..... F23C 99/00 431/7
2,016,839 A * 10/1935 Schoenberger ..... F23Q 9/00 251/257
2,415,223 A * 2/1947 Stangle ..... A47J 37/06 126/92 R
2,822,799 A * 2/1958 Sterick ..... F23C 99/00 126/92 B
3,084,736 A * 4/1963 Mentel ..... F23D 14/145 431/329
3,229,682 A * 1/1966 Perlmutter ..... H01L 31/00 126/698
3,251,355 A * 5/1966 Keating ..... A47J 36/26 126/40
3,265,057 A * 8/1966 Horne ..... F24C 3/042 126/92 B
3,561,422 A * 2/1971 Colin-Smith ..... F24C 1/16 126/92 B
3,586,823 A * 6/1971 Schier ..... H05B 3/00 392/418
3,650,662 A * 3/1972 Werring ..... F21H 1/00 431/329
3,814,573 A * 6/1974 Karlovetz ..... F23D 14/145 431/329
3,857,670 A * 12/1974 Karlovetz ..... D06F 67/02 431/329
3,870,031 A * 3/1975 Kruper ..... A47J 37/06 126/39 J
3,895,622 A * 7/1975 Krueger ..... A47J 37/0713 126/38
4,039,275 A * 8/1977 McGettrick ..... F23D 14/145 431/329
4,160,577 A * 7/1979 Berg ..... F28F 13/18 359/351
4,269,590 A * 5/1981 Baumanns ..... F23D 14/14 126/92 B
4,354,479 A * 10/1982 Haruhara ..... F23C 3/00 126/92 AC
4,375,214 A * 3/1983 Wysong ..... F24C 15/24 126/86
4,430,987 A * 2/1984 Heller ..... F24C 15/24 126/39 D
4,825,846 A * 5/1989 Fraioli ..... F23D 14/125 126/92 AC
4,889,103 A * 12/1989 Fraioli ..... F23D 14/125 126/92 AC
5,088,919 A * 2/1992 De Bruyne ..... F23D 14/16 126/92 AC
6,575,154 B1 * 6/2003 Freeman, Jr. ..... F24C 3/14 126/38
6,761,558 B1 * 7/2004 Kim ..... F23D 14/125 431/4
7,086,396 B2 * 8/2006 Waters ..... F24C 1/12 126/92 AC
9,423,538 B2 * 8/2016 Tillotson ..... G02B 5/136
2004/0096795 A1 * 5/2004 Abbasi ..... F27B 17/0016 432/20
2008/0236564 A1 * 10/2008 Burtea ..... F23D 14/145 126/39 K
2008/0283041 A1 * 11/2008 Burtea ..... A21B 2/00 126/39 BA
2010/0277801 A1 * 11/2010 Nakajima ..... G02B 5/124 359/530
2012/0000457 A1 * 1/2012 Paysant ..... A47J 37/0713 126/25 R
2014/0242529 A1 * 8/2014 Arnold, III ..... F23D 14/56 431/157
2016/0298838 A1 10/2016 Karkow et al.
2017/0122555 A1 * 5/2017 Owens ..... F23D 14/145
2017/0261661 A1 * 9/2017 Kiyoto ..... G02B 5/12
2018/0135861 A1 * 5/2018 Best ..... F24C 3/047
2019/0195500 A1 * 6/2019 Tseng ..... A21B 1/28
2019/0195501 A1 * 6/2019 Tseng ..... A21B 1/02
2019/0195502 A1 * 6/2019 Tseng ..... A21B 1/02
2019/0195503 A1 * 6/2019 Tseng ..... F24C 15/32
2019/0195504 A1 * 6/2019 Tseng ..... F24C 15/24
2019/0195506 A1 * 6/2019 Tseng ..... F23D 14/08
2019/0195560 A1 * 6/2019 Tseng ..... F24B 1/24
2019/0195561 A1 * 6/2019 Tseng ..... F24B 1/24

FOREIGN PATENT DOCUMENTS

CN 106595299 A 4/2017
CN 207648609 U 7/2018
DE 10222450 A1 8/2003
EP 0221686 A1 5/1987
JP 58099608 A * 6/1983 ..... F23D 14/125
JP 2000136101 A 5/2000
TW M271528 U 8/2005
TW M543657 U 6/2017
TW M563762 U 7/2018

OTHER PUBLICATIONS

Examination Report for TW107130609, dated Apr. 30, 2019, Total of 4 pages.
Search Report for TW107130609, dated Apr. 30, 2019, Total of 1 page.
English Abstract for TWM271528, Total of 1 page.
English Abstract for TWM563762, Total of 1 page.
English abstract for DE10222450, Total of 1 page.
Extended European search report for EP19193540.2, dated Jan. 20, 2020, Total of 7 pages.
English abstract for CN103236589, total of 1 page.
English abstract for CN106595299, total of 1 page.
English abstract for CN204380436, total of 1 page.
English abstract for CN207648609, total of 1 page.
English abstract for JP2000136101, total of 1 page.
Search report for CN201811010417.0, dated Dec. 3, 2020, Total of 2 pages.

* cited by examiner

COMBUSTION DEVICE

BACKGROUND OF THE INVENTION

1. Technical Field

The present invention is related to a combustion device, and more particularly to a combustion device which generates infrared rays.

2. Description of Related Art

Generally speaking, gas combustion devices burn gas to generate flame for heating an object. When using gas combustion devices to heat an object, heat is conducted from the surface of the object to the inside thereof such that the surface is heated greater while the interior gets less heat, resulting in the object not being heated uniformly.

To resolve the above problem, there is a known infrared ray heat source device shown in Taiwan Utility Model M543657, which is characterized by penetrating objects with infrared rays and heating the surface as well as the interior simultaneously. At the patent, the flame generator 3 outputs flames for heating an arc-shaped mesh structure 1 to generate infrared rays which are scattered outwardly from a second surface 12 of the arc-shaped mesh structure 1. However, the arc-shaped mesh structure 1 causes the scattered infrared rays to be less concentrated in the scattering directions, resulting in infrared intensity received by an object per unit area being less uniform when the infrared rays scattered by the infrared ray heat source device are applied to the object.

Hence, it is still a need to provide an improvement on the design of the conventional infrared ray heat source devices so as to overcome the aforementioned drawbacks.

BRIEF SUMMARY OF THE INVENTION

In view of the above, a purpose of the present invention is to provide a combustion device which scatters infrared rays uniformly in the same direction.

The present invention provides a combustion device comprising at least one burner, a supporting assembly and an infrared ray generation mesh. Wherein, the at least one burner has a flame outlet and burns gas to generate flames through the flame outlet; the supporting assembly includes a front cover which has a flat cover plate possessing a plurality of holes passing between an exterior surface and an interior surface thereof; the infrared ray generation mesh disposed on the supporting assembly corresponds to the flame outlet and faces the interior surface of the cover plate; the infrared ray generation mesh is flame heated by the at least one burner to generate infrared rays passing through the holes.

The advantage of the present invention is to help infrared rays scatter uniformly in the same direction through the flat cover plate disposed on the front cover so as to effectively prevent a reduction of infrared intensity received by an object per unit area owing to excessive infrared scattering range.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
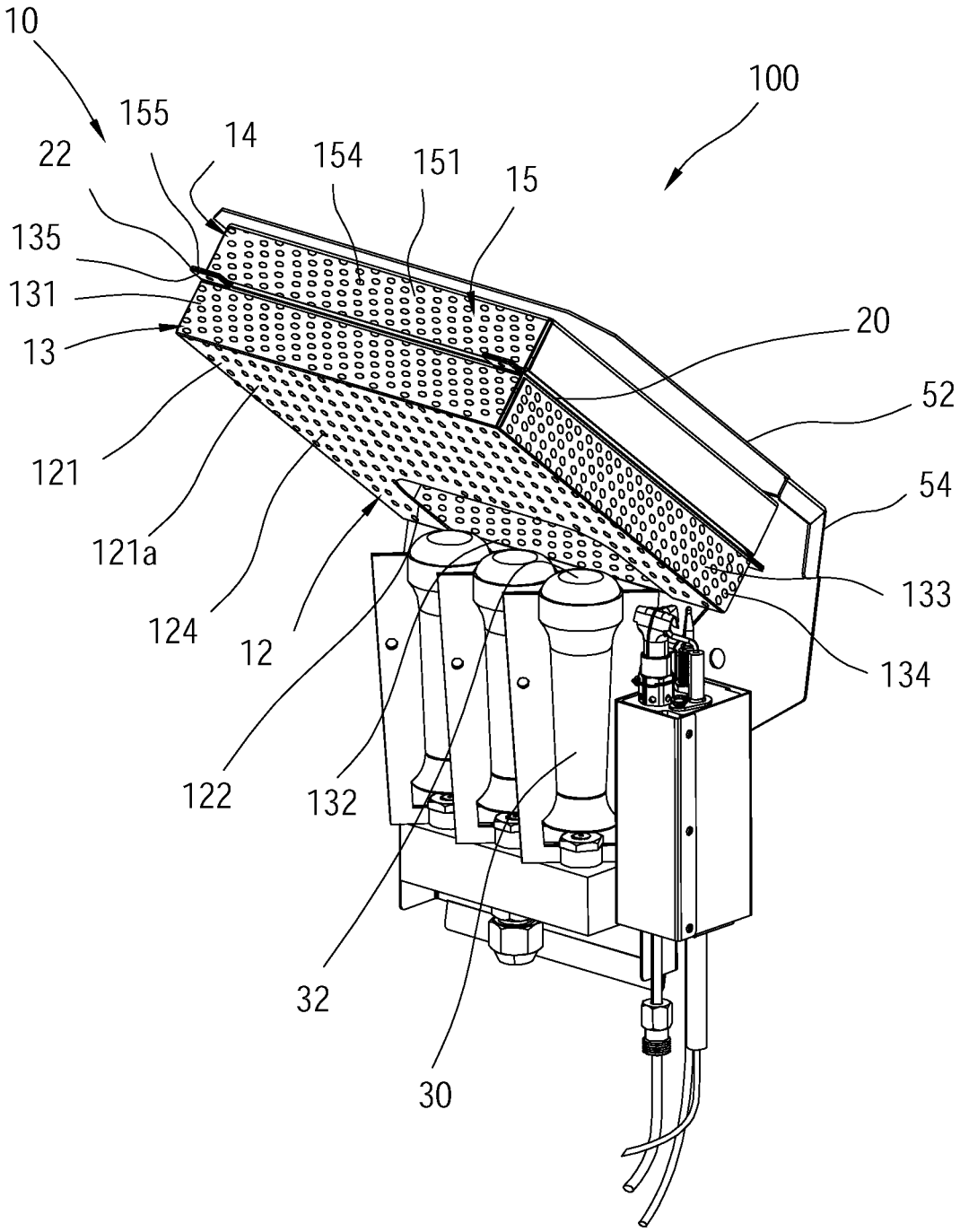
FIG. 1 is a perspective view of a combustion device of a first embodiment according to the present invention.

The following illustrative embodiments and drawings are provided to illustrate the disclosure of the present invention, these and other advantages and effects can be clearly understood by persons skilled in the art after reading the disclosure of this specification.

As illustrated in FIG. 1 to FIG. 7, a combustion device 100 of the first embodiment according to the present invention includes a supporting assembly 10, an infrared ray generation mesh 20, an infrared reflective plate 40 and at least one burner 30.

Figure 3:
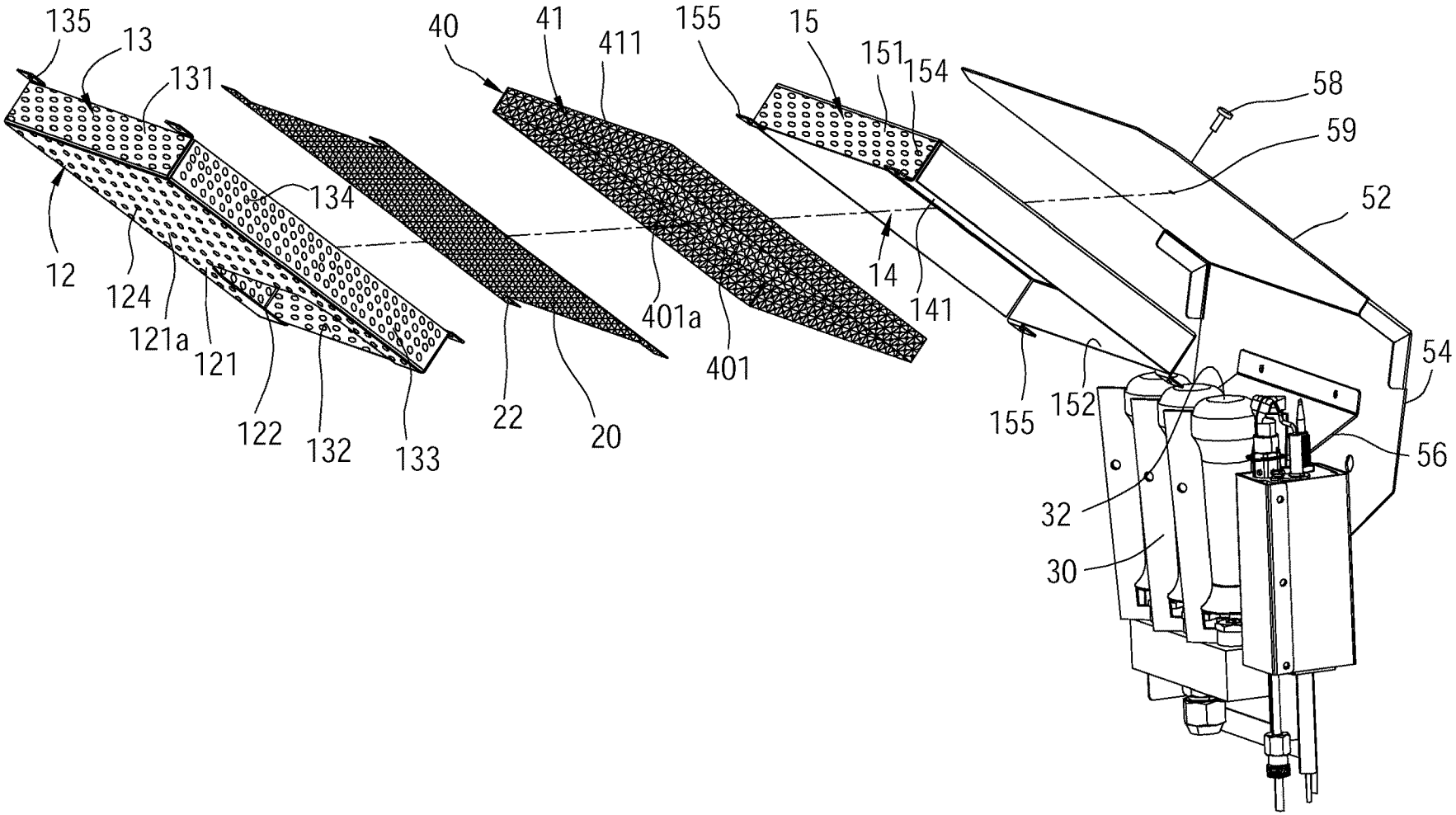
FIG. 3 is an exploded view of the combustion device of the first embodiment.

As illustrated in FIG. 3, the supporting assembly 10 comprises a tilted metallic front cover 12 and a rear cover 14. Wherein, the front cover 12 has a flat rectangular cover plate 121 including a plurality holes 124 passing between an exterior surface 121*a* and an interior surface 121*b* thereof. In the current embodiment, the front cover 12 further comprises a surrounding wall 13 which has an upper side wall 131 connected to a top edge of the cover plate 121, a lower side wall 132 connected to a bottom edge of the cover plate 121, and two side walls 133 connected to corresponding two side edges of the cover plate 121. All the upper side wall 131, the lower side wall 132 and two side walls 133 have a plurality of holes 134 passing between an interior surface and an exterior surface of the surrounding wall. The surrounding wall 13 of the front cover 12 extends outwardly to form a plurality of first extension parts 135, each of which is located respectively on the upper side wall 131 and the lower side wall 132 in the current embodiment. The cover plate 121 has an opening 122 which is located in the vicinity of the bottom edge of the cover plate 121 and passes through the interior surface and the exterior surface thereof.

The rear cover 14 which is tilted and metallic has a flat rectangular rear plate 141 and further includes a surrounding wall 15 connected to a peripheral edge of the rear plate 14. The surrounding wall 15 has an upper side wall 151 and a lower side wall 152, wherein the upper side wall 151 is connected to a top edge of the rear plate 141 and has a plurality holes 154 passing between an interior surface and an exterior surface of the surrounding wall 15 of the rear cover 14. The surrounding wall 15 of the rear cover 14 extends outwardly to form a plurality of second extension parts 155, each of which is located respectively on the upper side wall 151 and the lower side wall 152 in the current embodiment.

Figure 2:
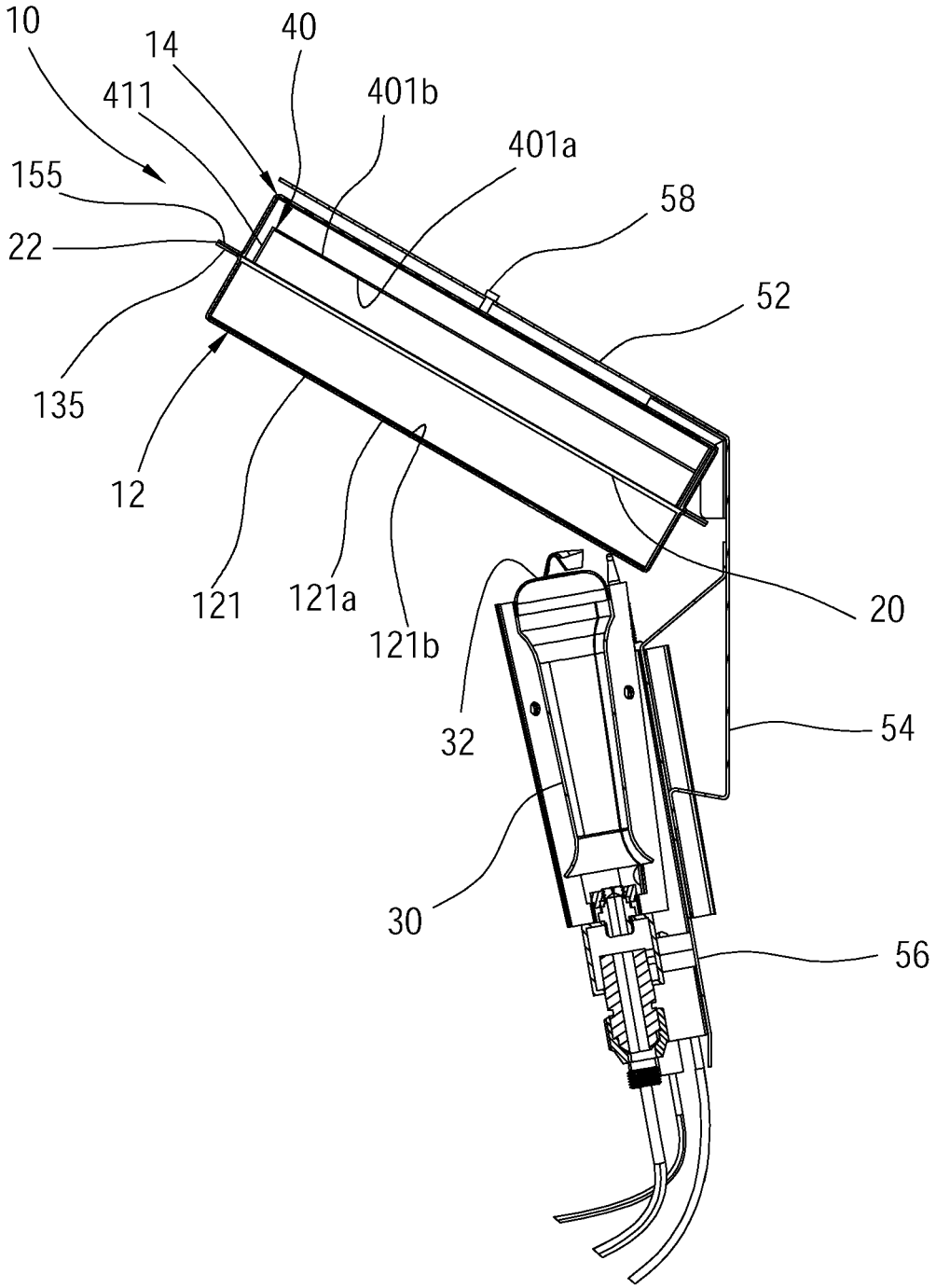
FIG. 2 is a cross-sectional view of the combustion device of the first embodiment.

As illustrated in FIG. 2, the infrared ray generation mesh 20 which is disposed between the front cover 12 and the rear cover 14 of the supporting assembly 10 faces the interior surface 121*a* of the cover plate 121. A peripheral edge of the infrared ray generation mesh 20 extends outwardly to form a plurality of fixation parts 22 (as shown in FIG. 3), each of which corresponds to each of the first extension parts 135 and each of the second extension parts 155. And, each of the fixation parts 22 is disposed between each of the first extension parts 135 and corresponding one of the second extension parts 155 by bolt-nut combining or welding, such that the front cover 12 and the infrared ray generation mesh 20 are fixed to the rear cover 14. The infrared ray generation mesh 20 is flame heated to generate infrared rays emitted outwardly out of the holes 124 of the front cover 12. The infrared ray generation mesh 20 could be a ceramic, metal or alloy material and, in the current embodiment, is iron-chromium-aluminum alloy.

As illustrated in FIG. 1, the at least one burner 30 includes a flame outlet 32 disposed below the opening 122 of the cover plate 121 and the infrared ray generation mesh 20 corresponds to the flame outlet 32. The at least one burner 30 burns gas for generating flames out of the flame outlet 32 to apply the flames to the infrared ray generation mesh 20. In the current embodiment, the at least one burner 30 includes a plurality of burners 30, each flame outlet 32 of which generates flames passing through the opening 122 of the cover plate 121 so as to heat the infrared ray generation mesh 20. In practice, it works as long as flames are applied to the infrared ray generation mesh 20. Therefore, the burner 30 can extend into the opening 122 such that the location of the flame outlet 32 is located in a chamber formed by the front cover 12 and the rear cover 14 and is adjacent to the infrared ray generation mesh 20.

As illustrated in FIG. 2, the infrared reflective plate 40 is located between the rear cover 14 and the infrared ray generation mesh 20. Wherein, the infrared reflective plate 40 which is tilted has a flat rectangular main board 401 corresponding the infrared ray generation mesh 20 (as shown in FIG. 3). The infrared reflective plate 40 further comprises a surrounding wall 41 connected to a peripheral edge of the main board 401, wherein the surrounding wall 41 of the infrared reflective plate 40 has an upper side wall 411 connected to a top edge of the main board 401. The height of the surrounding wall 41 of the infrared reflective plate 40 is lower than that of the surrounding wall 15 of the rear cover 14. The infrared reflective plate 40 has a reflective surface 401*a* and an exterior surface 401*b*, wherein the reflective surface 401*a* facing the infrared ray generation mesh 20 is adapted to reflect back infrared rays generated by the infrared ray generation mesh 20, such that the reflected infrared rays apply to the infrared ray generation mesh 20 and are emitted outwardly from the holes 124 of the front cover 12. The infrared reflective plate 40 is metallic, such as stainless steel.

Figure 4:
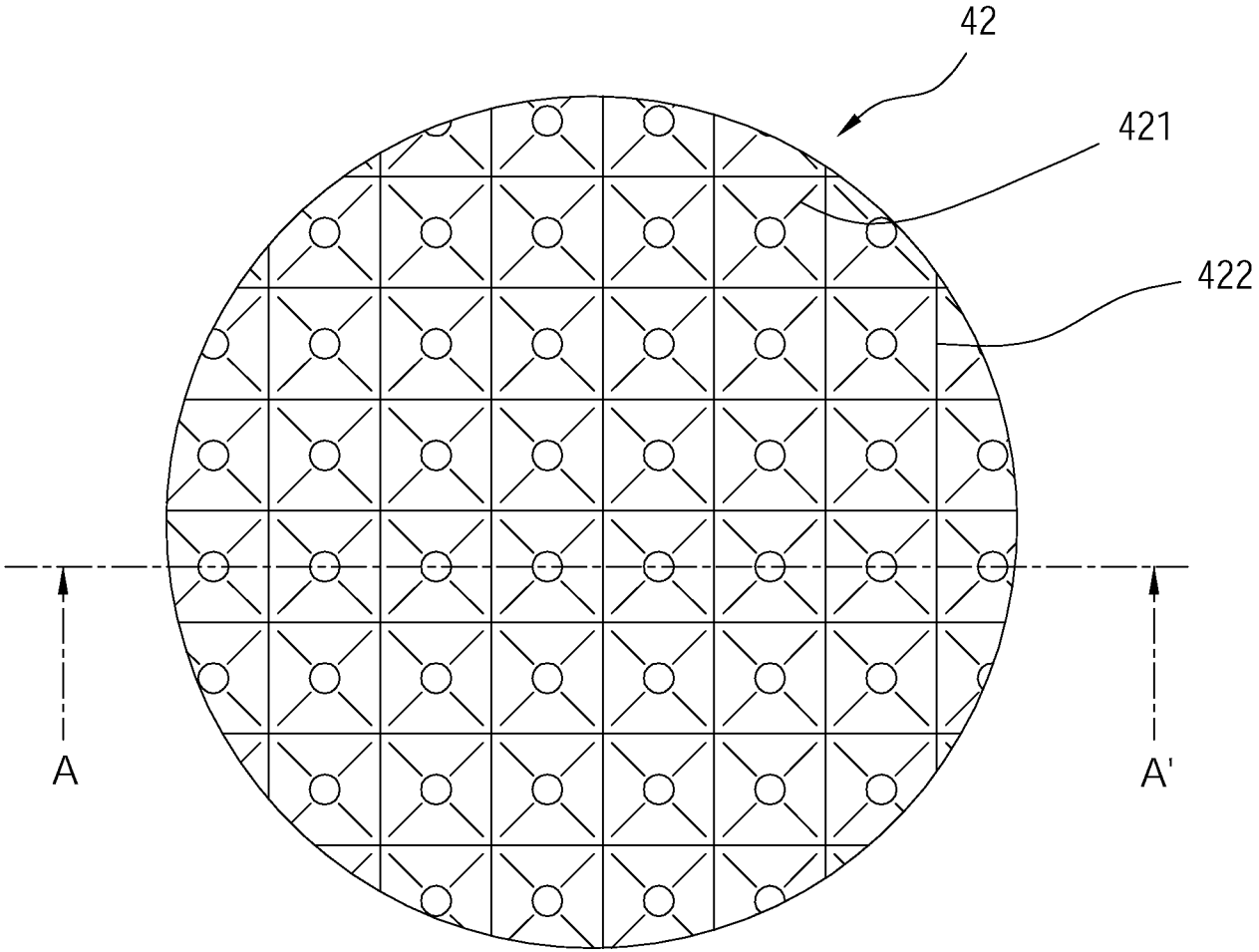
FIG. 4 is a top view showing a matrix arrangement of a reflective structure of an infrared reflective plate of the first embodiment.
Figure 5:
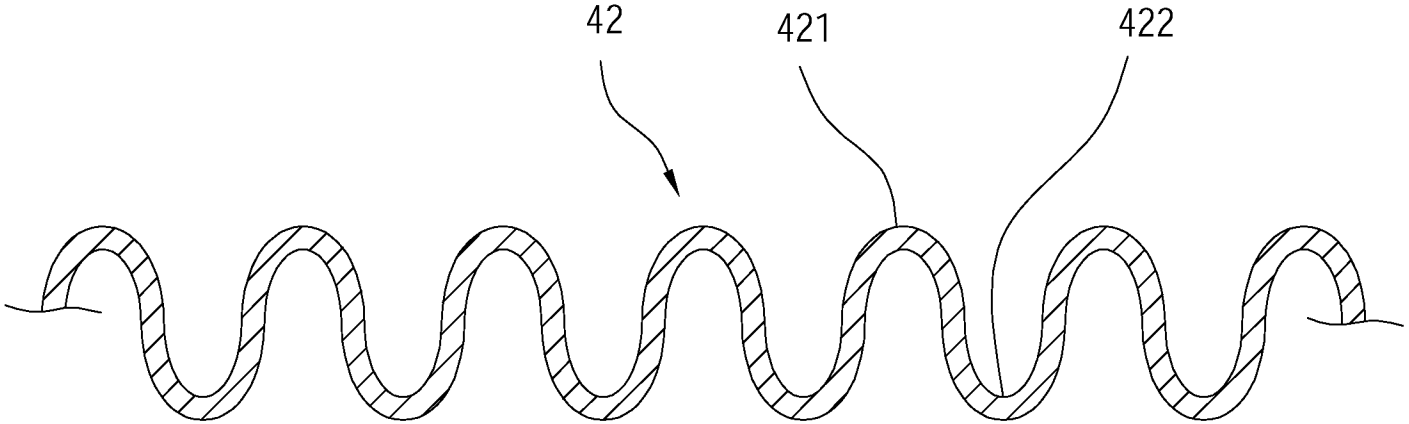
FIG. 5 is a cross-sectional view of FIG. 4 along lines A-A'.
Figure 6:
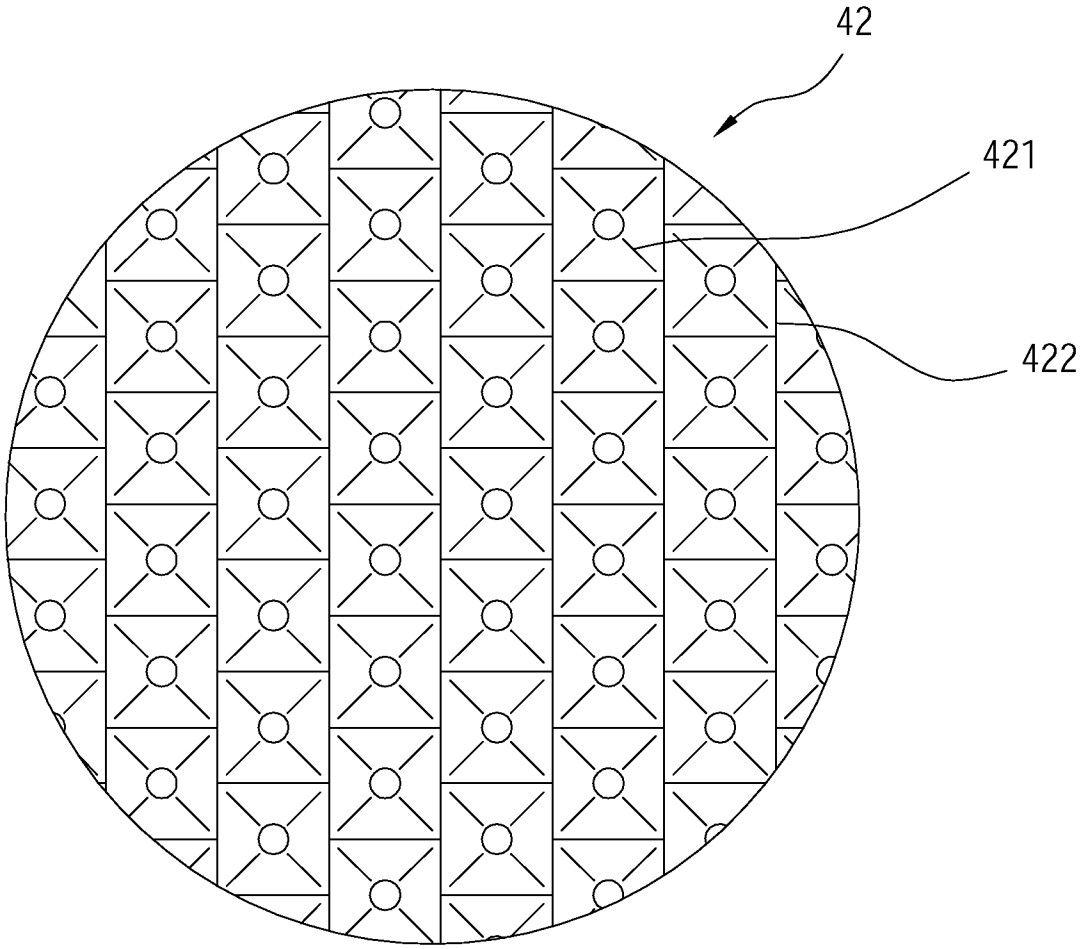
FIG. 6 is a top view showing a staggered arrangement of a reflective structure of an infrared reflective plate of the first embodiment.

The reflective surface 401*a* of the infrared reflective plate 40 includes a reflective structure 42 which comprises a plurality of convex parts 421 and a plurality of embossings 422, each of the embossings 422 located between two adjacent convex parts 421. The convex parts 421 and the embossings 422 are roll-embossed out of a metallic plate and then the metallic plate with the reflective structure 42 is folded to form the shape of the main board 401 and the surrounding wall 41 such that the infrared reflective plate 40 is full of the reflective structure 42. In the current embodiment, the convex parts 421 are conical and form a matrix arrangement (as shown in FIGS. 4 and 5) or a staggered arrangement (as shown in FIG. 6).

In the current embodiment, the combustion device further comprises a bracket 50. As illustrated in FIG. 3, the bracket 50 includes an upper supporting plate 52, a middle supporting plate 54, a lower supporting plate 56 and an engaged member 58. The bracket 50 is for fixing the front cover 12, the rear cover 14 and the burners 30 to be at the relative position. The middle supporting plate 54 is fixed between the upper supporting plate 52 and the lower supporting plate 56. A fixed hole 59 is near the center of the upper supporting plate 52, wherein the engaged member 58 penetrates the fixed hole 59 to fix the rear cover 14 to the upper supporting plate 52, while the burners 30 are fixed to the lower supporting plate 56.

Figure 7:
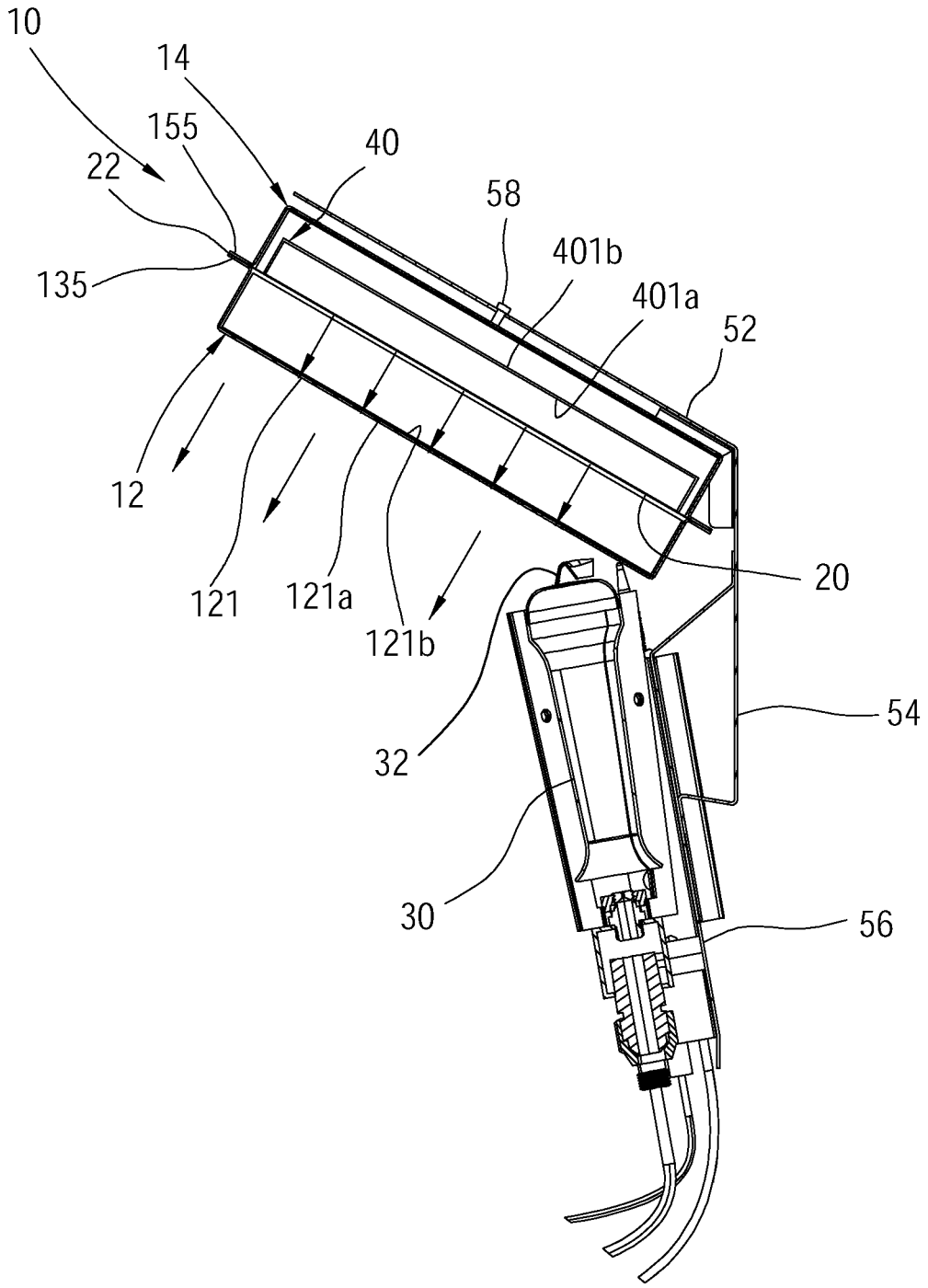
FIG. 7 is a schematic view showing infrared rays emitted from the combustion device of the first embodiment.

Therefore, as illustrated in FIG. 7, when the flames out of the flame outlets 32 of the burners 30 are applied to the infrared ray generation mesh 20, the infrared ray generation mesh 20 is heated to generate infrared rays, part of which passes the holes 124 of the front cover 12 to be emitted outwardly and another part of which is emitted toward the reflective surface 401*a* of the infrared reflective plate 40. With the reflective structure 42, the reflective surface 401*a* reflects the another part of the infrared rays to the direction of the front cover 12 and helps the reflected infrared rays to be scattered uniformly to the infrared ray generation mesh 20. Whereby, the infrared ray generation mesh 20 could be heated again by the reflected infrared rays so as to enhance the effect of reflection. In practice, the reflective surface 401*a* need not include the reflective structure 42 but a flat surface; however, the reflective surface 401*a* is preferably provided with the reflective structure 42 to achieve the effect of reflecting infrared rays uniformly. Additionally, the front cover 12 is heated by flames out of the flame outlets 32 to generate infrared rays as well, and the flames pass through the holes 124 to form open fire.

It is noted that since the front cover 12 is flat, the scattering direction of infrared rays generated by the front cover 12 is essentially perpendicular to the flat cover plate 121, such that the infrared rays emitted by the combustion device 100 scatter along the same direction to apply uniformly to an object. The object receives more uniform infrared intensity per unit area so as to resolve the aforementioned problem that owing to the arc-shaped mesh structure of conventional combustion devices, the scattered infrared intensity is less uniform.

In addition, the convex parts on the reflective surface 401*a* of the infrared reflective plate 40 have different densities, wherein a density of the convex parts on the surrounding wall 41 is greater than a density of the convex parts on the main board 401. In this way, the combustion device 100 further enhances the accumulation of the infrared rays in the vicinity of the surrounding wall 41 thanks to the greater density of the convex parts on the surrounding wall 41, thereby the infrared intensity generated by the infrared ray generation mesh 20 tends to be more uniform.

Furthermore, a density of the convex parts on the middle area of the main board 401 can be smaller than a density of the convex parts on the peripheral area of the main board 401, such that the infrared ray reflecting efficiency of the main board 401 is increased gradually from the middle area of the main board 401 to the peripheral area; that is, the peripheral area expresses greater infrared ray reflecting efficiency. Whereby, the area of the infrared ray generation mesh 20 corresponding to the peripheral area is heated more so the infrared intensity generated by the infrared ray generation mesh 20 tends to be more uniform.

Figure 8:
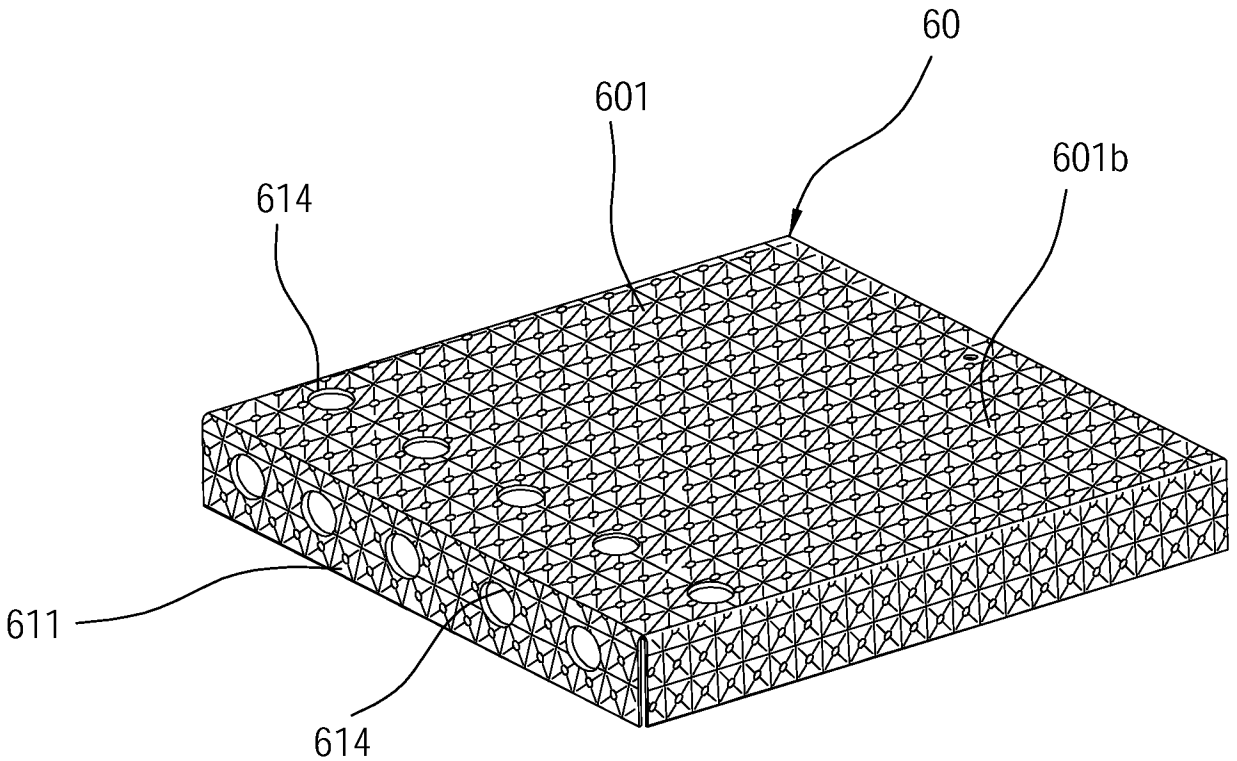
FIG. 8 is a perspective view of an infrared reflective plate of a second embodiment.

An infrared reflective plate 60 of a combustion device of the second embodiment according to the present invention is shown in FIG. 8. The infrared reflective plate 60 includes a basic structure similar to the infrared reflective plate 40 of the first embodiment; the difference between these two is in that, an upper side wall 611 of the infrared reflective plate 60 has a plurality of holes 614, while the vicinity of a top edge of the main board 601 has a plurality of holes 614 as well. When the flames generated by the flame outlet 32 flow along a reflective surface 601*a* of the infrared reflective plate 60 toward the top edge of the infrared reflective plate 60, the holes 614 help the flames that have flowed to the vicinity of the top edge of the infrared reflective plate 60 to pass through the holes 614 to form open fire, such that the gas flows more smoothly. With the holes 614, flames help the infrared ray generation mesh 20 and the front cover 12 to be heated more uniformly, resulting in more uniform infrared intensity emitted by the combustion device 100. It is noted that both the upper side wall 611 of the infrared reflective plate 60 and the vicinity of the top edge of the main board 601 may have a plurality of holes 614.

Figure 9:
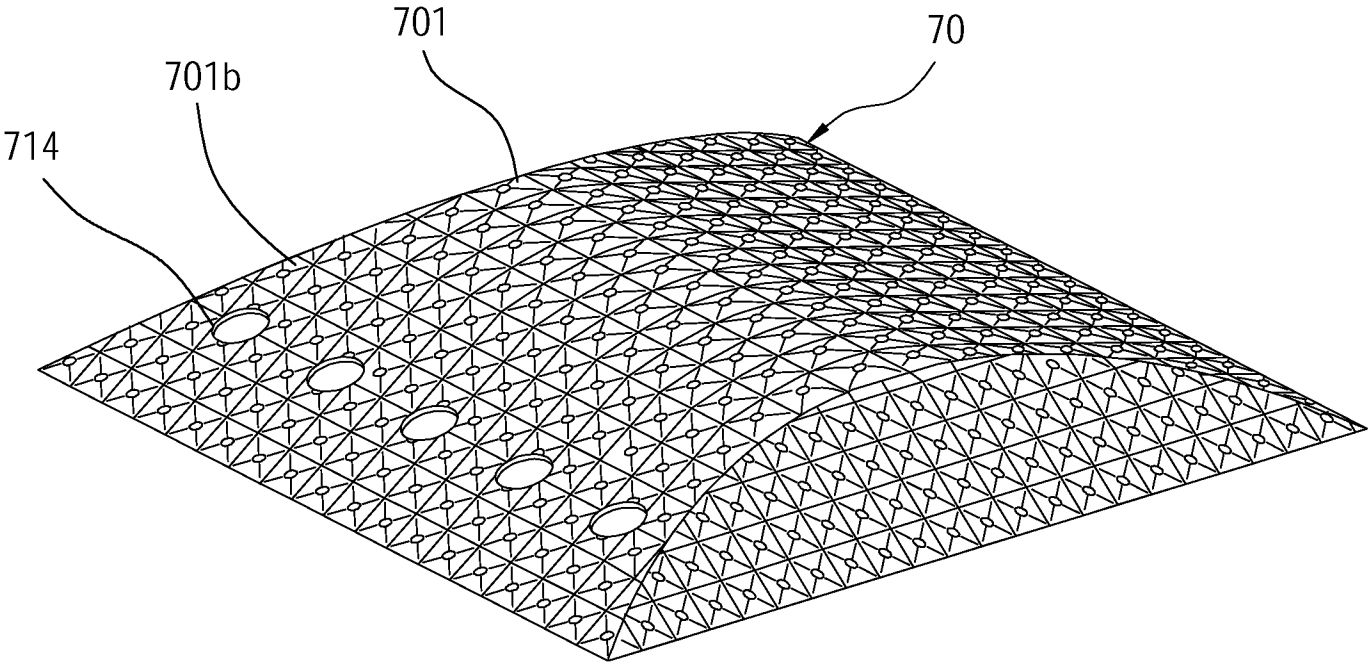
FIG. 9 is a perspective view of an infrared reflective plate of a third embodiment.

An infrared reflective plate 70 of the combustion device 100 of the third embodiment according to the present invention is shown in FIG. 9. Wherein, the infrared reflective plate 70 includes a reflective surface 701*a* and an exterior surface 701*b*; a main board 701 of the infrared reflective plate 70 has a curved arc shape and the infrared reflective plate 70 is tilted; the vicinity of the top edge thereof has a plurality of holes 714 passing through the reflective surface 701*a* and the exterior surface 701*b*. With the arc-shaped main board 701, the flames generated by the flame outlet 32 flows smoothly along the reflective surface 701*a* of the arc-shaped main board 701 toward the vicinity of the top edge of the main board 701. Meanwhile, the flames help the infrared ray generation mesh 20 and the front cover 12 to be heated more uniformly, resulting in uniform infrared intensity emitted by the combustion device 100.

Figure 10:
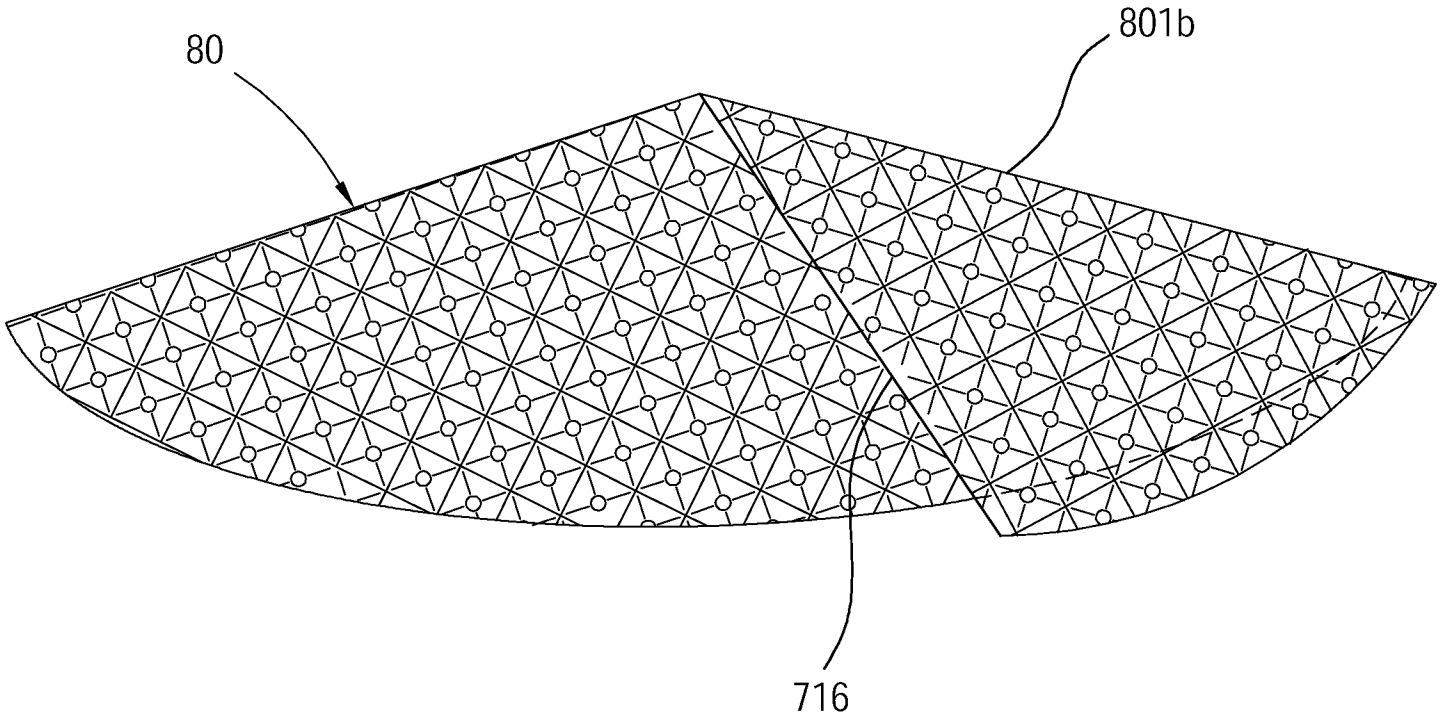
FIG. 10 is a perspective view of an infrared reflective plate of a fourth embodiment.

An infrared reflective plate 80 of the combustion device of the fourth embodiment according to the present invention is shown in FIG. 10. The infrared reflective plate 80 includes a reflective surface 801*a* and an exterior surface 801*b*, wherein the infrared reflective plate 80 is concaved from the reflective surface 801*a* toward the exterior surface 801*b* to form an arc shape. In the current embodiment, the infrared reflective plate 80 is bent into a concave arc shape by a metallic plate, and at least one gap 716 is formed at a portion where the metallic plate overlaps to connect to the reflective surface 801*a* and the exterior surface 801*b* of the infrared reflective plate 80. The infrared reflective plate 80 is disposed between the rear cover 14 and the infrared ray generation mesh 20. With the arc-shaped reflective surface 801*a*, the flames generated by the flame outlet flows more smoothly along the reflective surface 801*a* of the infrared reflective plate 80 toward the vicinity of the top edge of the infrared reflective plate 80, and with the design of allowing partial airflow through the gap, gas flows more smoothly. Meanwhile, the flames help the infrared ray generation mesh 20 and the front cover 12 to be heated more uniformly, resulting in more uniform and increasing infrared intensity emitted by the combustion device 100.

Figure 11:
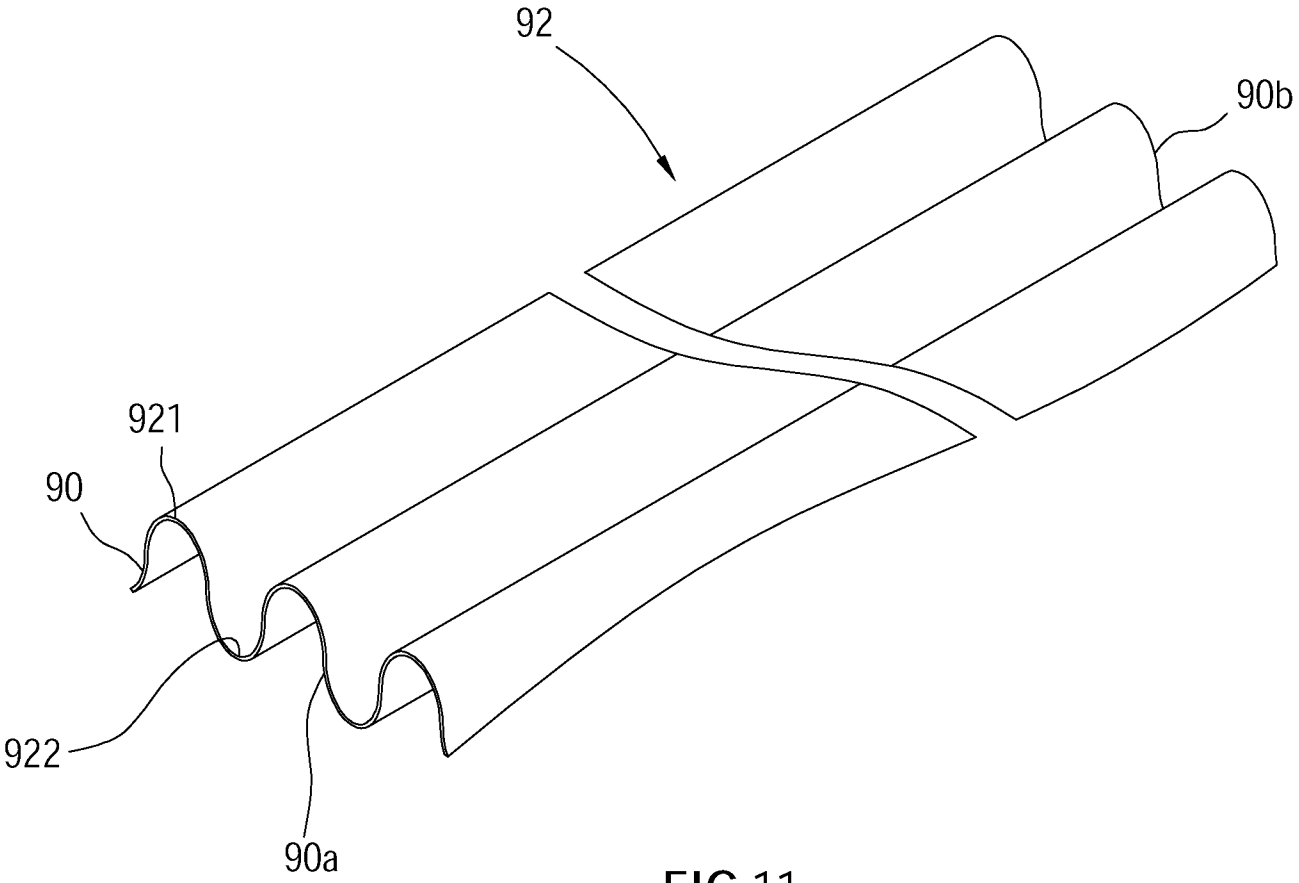
FIG. 11 is a partial perspective view of an infrared reflective plate of a fifth embodiment.

In addition, an infrared reflective plate 90 of the combustion device of the fifth embodiment according to the present invention is shown in FIG. 11. In practice, each of the convex parts 921 on the reflective structure 92 of the infrared reflective plate 90 is a strap in shape and forms a parallel arrangement with each other. A long axis of the convex parts 921 and a long axis of the embossings 922 extend along a predetermined direction from one end 90*a* of the infrared reflective plate 90 toward corresponding one end 90*b*.

As mentioned above, when infrared rays generated by the combustion device according to the present invention scatter from the holes of the front cover and from the front cover itself, the infrared rays are emitted outwardly along the same direction owing to the flat cover plate of the front cover, such that the intensity of heat per unit area an object heated by the infrared rays is more uniform.

In addition, with the reflective structural design of the infrared reflective plate, the flames are favorable to more uniformly heat the infrared ray generation mesh and the front cover, keep the high temperature of the infrared ray generation mesh, and help the combustion device generate stronger and more uniform infrared rays.

It must be pointed out that the embodiments described above are only some embodiments of the present invention. All equivalent structures which employ the concepts disclosed in this specification and the appended claims should fall within the scope of the present invention.

What is claimed is:

1. A combustion device, comprising:

at least one burner having a flame outlet, wherein the at least one burner is for burning gas to generate flames through the flame outlet;

a supporting assembly including a front cover, wherein the front cover has a flat cover plate which includes a plurality of holes passing between an exterior surface and an interior surface thereof; and an infrared ray generation mesh being disposed on the supporting assembly and corresponding to the flame outlet, the infrared ray generation mesh facing the interior surface of the cover plate, the infrared ray generation mesh being flame heated by the at least one burner to generate infrared rays passing through the holes;

wherein the supporting assembly includes a rear cover which has a rear plate and a surrounding wall connected to a peripheral edge of the rear plate; the front cover includes a surrounding wall which is connected to a peripheral edge of the cover plate and includes a plurality of first extension parts extending substantially perpendicular from the surrounding wall of the front cover, while a plurality of second extension parts extends substantially perpendicular from the surrounding wall of the rear cover, each of the first extension parts corresponds to each of the second extension parts; and a plurality of fixation parts extends substantially perpendicular from a peripheral edge of the infrared ray generation mesh, each of which is disposed between each of the first extension parts and the corresponding second extension part.

2. The combustion device of claim 1, further comprising an infrared reflective plate located between the rear cover and the infrared ray generation mesh, wherein the infrared reflective plate has a reflective surface facing the infrared ray generation mesh.

3. The combustion device of claim 2, wherein the reflective surface has a reflective structure; the reflective structure includes a plurality of convex parts and a plurality of embossings, each of the embossings located between two adjacent convex parts.

4. The combustion device of claim 3, wherein the convex parts form a matrix arrangement.

5. The combustion device of claim 3, wherein the convex parts form a staggered arrangement.

6. The combustion device of claim 3, wherein each of the convex parts is conical.

7. The combustion device of claim 3, wherein each of the convex parts is a strap in shape, and the convex parts form a parallel arrangement.

8. The combustion device of claim 3, wherein the infrared reflective plate includes a main board and a surrounding wall connected to a peripheral edge of the main board, and a density of the convex parts on the surrounding wall is greater than a density of the convex parts on the main board.

9. The combustion device of claim 3, wherein the infrared reflective plate includes a main board which has a middle area and a peripheral area outside the middle area; a density of the convex parts on the middle area is smaller than a density of the convex parts on the peripheral area.

10. The combustion device of claim 2, wherein the infrared reflective plate has at least one gap.

11. The combustion device of claim 2, wherein the infrared reflective plate has a plurality of holes.

12. The combustion device of claim 1, wherein the cover plate is rectangular.

13. The combustion device of claim 12, wherein the front cover includes an upper side wall which is connected to a top edge of the cover plate and has a plurality of holes.

14. The combustion device of claim 13, wherein the cover plate has an opening located on an opposite side of the top edge; the flame outlet of the at least one burner is disposed below the opening.

15. The combustion device of claim 13, wherein the supporting assembly includes a rear cover; the infrared ray generation mesh is disposed between the front cover and the rear cover; the rear cover includes an upper side wall which is located above the upper side wall of the front cover and has a plurality of holes.

16. The combustion device of claim 12, wherein the front cover includes two side walls connected to two side edges of the cover plate, each of the side walls has a plurality of holes.

* * * * *